US006464546B2

(12) United States Patent
LaCoy

(10) Patent No.: US 6,464,546 B2
(45) Date of Patent: Oct. 15, 2002

(54) ELECTRICAL CONTACTS

(75) Inventor: Donald Richard LaCoy, Bolyston, MA (US)

(73) Assignee: Smiths Group PLC, London (GB)

( * ) Notice: Subject to any disclaimer, the term of this patent is extended or adjusted under 35 U.S.C. 154(b) by 0 days.

(21) Appl. No.: 09/931,100

(22) Filed: Aug. 17, 2001

(65) Prior Publication Data

US 2002/0022411 A1 Feb. 21, 2002

(30) Foreign Application Priority Data

Aug. 17, 2000 (GB) ..... 0020154

(51) Int. Cl.[7] ..... H01R 13/187
(52) U.S. Cl. ..... 439/847; 439/930
(58) Field of Search ..... 439/843, 847, 439/846, 851, 930

(56) References Cited

U.S. PATENT DOCUMENTS

| | | | | |
|---|---|---|---|---|
| 2,450,529 A | * | 10/1948 | Sprigg | 439/851 |
| 2,900,631 A | * | 8/1959 | Love | 439/847 |
| 2,983,779 A | * | 5/1961 | Dumire et al. | 439/323 |
| 3,023,789 A | | 3/1962 | Bonhomme | |
| 3,107,966 A | | 10/1963 | Bonhomme | |
| 3,447,527 A | | 6/1969 | Cermak et al. | 124/52 |
| 3,470,527 A | | 9/1969 | Bonhomme | |
| 3,557,428 A | | 1/1971 | Bonhomme | 29/203 |
| 3,858,962 A | | 1/1975 | Bonhomme | |
| 4,138,188 A | * | 2/1979 | Shannon | 439/578 |
| 4,203,647 A | * | 5/1980 | Bonhomme | 439/851 |
| 4,723,923 A | | 2/1988 | Senor et al. | |
| 5,203,813 A | | 4/1993 | Fitzsimmons et al. | 29/876 |
| 5,326,289 A | * | 7/1994 | Leisey | 439/851 |
| 6,102,746 A | | 8/2000 | Nania et al. | 439/675 |

FOREIGN PATENT DOCUMENTS

| | | |
|---|---|---|
| DE | 19941515.3 | 8/1999 |
| EP | 442639 A2 | 8/1991 |
| GB | 2065993 A | 7/1981 |

* cited by examiner

*Primary Examiner*—Brian Sircus
*Assistant Examiner*—Hae Moon Hyeon
(74) *Attorney, Agent, or Firm*—Connolly Bove Lodge & Hutz LLP

(57) ABSTRACT

A hyperboloid electrical socket contact has a tubular ferrule with several oblique slots extend along its length. Resilient contact wires extend along the slots so that they project inwardly into the bore through the ferrule midway along their length to form a contact region for an inserted male pin. The ends of the wires are bent into locating notches in the ferrule where they are welded.

15 Claims, 2 Drawing Sheets

ELECTRICAL CONTACTS

BACKGROUND OF THE INVENTION

This invention relates to electrical contacts.

The invention is more particularly concerned with hyperboloid socket contacts.

Hyperboloid socket contacts have a number of resilient wires extending longitudinally of a tubular structure, which is twisted at opposite ends through a small angle relative to one another so that the internal diameter of the structure midway along its length is reduced, thereby forming a resilient contact region for a male pin contact inserted in the socket. Opposite ends of the wires are retained by being wrapped around the inside and outside of respective rings to which they are welded. This structure may be retained within an outer body forming a part of the contact. Contacts of this kind are described, for example, in U.S. Pat. No. 3,023,789, U.S. Pat. No. 3,107,966, U.S. Pat. No. 3,470,527, U.S. Pat. No. 3,557,428, U.S. Pat. No. 3,858,962 and U.S. Pat. No. 5,203,813. Hyperboloid contacts are sold by Hypertac Limited of London, England, by Hypertronics Inc of Hudson, Mass., USA and by Interconnectron GmbH of Deggendorf, Germany.

Hyperboloid contacts have various advantages over other contacts in that they can have a low contact resistance, a low insertion force, a long effective life, they can carry high currents, they have an excellent wiping action and can be stable under shock and vibration. The problem with such contacts, however, is that the way in which the wires are retained at their ends makes them relatively expensive to manufacture so their use is limited to applications where high integrity is required. It has been proposed to form a similar contact by stamping from a sheet of metal such as to form parallel strips that would serve a similar function as the wires in hyperboloid contacts. Forms of stamped contact are described in DE19941515.3, EP442639, GB2065993 and U.S. Pat. No. 4,723,923. These stamped contacts can be produced at low cost but they may not be suitable for all applications.

BRIEF SUMMARY OF THE INVENTION

It is an object of the present invention to provide an alternative contact.

According to one aspect of the present invention there is provided an electrical socket contact including a tubular member and a plurality of metal wires supported by the tubular member, the wires being attached at opposite ends at respective locations on the tubular member, the locations at opposite ends being spaced angularly from one another, the tubular member having a plurality of slots extending between the locations obliquely of the tubular member, and the wires towards their ends extending externally of the tubular member and between their ends extend along respective ones of the slots obliquely of the socket such that at a region between their ends the wires extend inwardly beyond the inner surface of the tubular member to provide a contact region.

The tubular member preferably has an external member towards each end spaced from the ends by respective end regions, each wire being bent at the external member to extend along the surface of the respective end region at both ends. The tubular member preferably has a locating notch at each end for each wire. The tubular member is preferably of a metal and the wires are welded at their ends to the tubular member. The wires are preferably spring metal wires of circular section. The contact may include an outer metal tubular body within which the tubular member is inserted, the outer tubular body including a contact portion to which a wire can be attached. Alternatively, the tubular member may be of metal and be formed at one end with a contact portion to which a wire can be attached. The wires preferably extend on the inside of the tubular member in a central region only of the tubular member According to another aspect of the present invention there is provided an electrical socket contact having a plurality of metal wires extending along the socket in a hyperboloid arrangement and exposed for contact with a male contact member inserted within the socket, the socket including two annular regions at opposite ends of the socket, and opposite ends of the wires being attached to respective ones of the annular regions and extend along the external surface of the annular region, without extending along its internal surface.

According to a further aspect of the present invention there is provided a method of making an electrical socket, comprising the steps of providing a plurality of electrically-conductive spring wires, providing a tubular member having two annular regions at opposite ends and a plurality of slots extending obliquely of the tubular member between the two annular regions, positioning the wires to extend along respective ones of the slots and along the external surface of respective annular regions at opposite ends and securing the wires at opposite ends with the annular regions.

The wires are preferably assembled on the tubular member from the exterior of the tubular member and may be secured with the annular regions by welding.

According to yet another aspect of the invention there is provided an electrical socket made by a method according to the above further aspect of the invention.

An assembly including an electrical socket and its method of manufacture, according to the present invention, will now be described, by way of example, with reference to the accompanying drawings.

DETAILED DESCRIPTION OF THE PREFERRED EMBODIMENT

Figure 1:
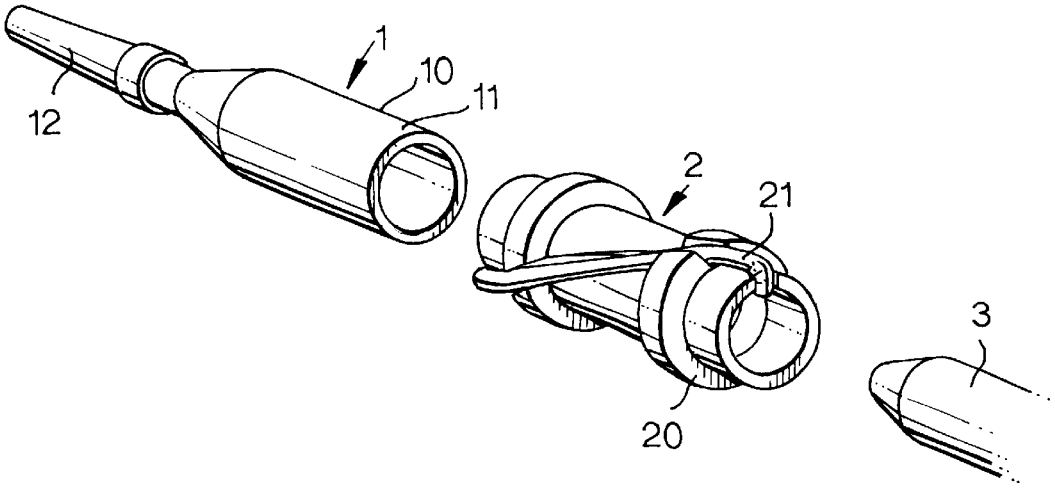
FIG. 1 is an exploded, perspective view of the socket assembly from its forward end.
Figure 2:
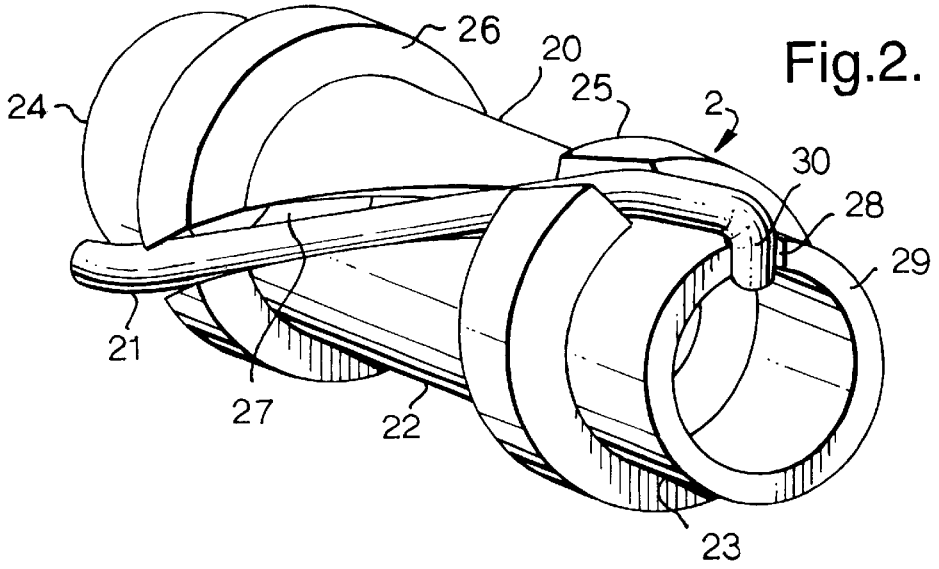
FIG. 2 is an enlarged, perspective view of a part of the assembly from its forward end.

With reference first to FIGS. 1 and 2, the socket assembly comprises an outer body 1 and a socket 2 inserted within the body. In use, the socket assembly is supported by extending through a hole in an insulator body (not shown) within a connector or the like, together with other socket assemblies.

The body 1 is machined from metal and has a tubular forward end portion 10, which is open at its forward end 11. The rear end of the body 1 is formed into a contact portion in the form of a tail 12 to which a wire can be attached, such as by wrapping and soldering.

The socket 2 is of generally tubular form comprising a tubular ferrule 20 supporting five metal spring wires 21, only one of which is shown. The ferrule 20 is a machined hollow tube of metal, although it need not be of a conductive material and could, for example, be of a plastics material. The ferrule 20 has a central portion 22 of cylindrical shape and two annular end regions 23 and 24 separated from the central portion by respective externally-projecting flanges 25 and 26. The central portion 22 has five slots 27 (only one of which is shown), one for each wire 21. The slots 27 extend obliquely of the ferrule 20, that is, longitudinally with opposite ends displaced angularly from one another around the ferrule. The slots 27 extend through the length of both flanges 25 and 26 but not along the end regions 23 and 24. Five locating notches 28, one for each wire 21 are formed in the end face 29 of the end regions 23 and 24, in alignment with the ends of the slots 27.

The wires 21 are of plated spring metal and have a conventional circular section. The wires 21 extend along the entire length of the ferrule 20, along respective ones of the slots 27 in the central portion 22 and the flanges 25 and 26, with the ends of the wires extending along the external surface of the annular end regions 23 and 24. The end tips 30 of the wires 21 are bend inwardly through an angle of 90° and locate in respective ones of the notches 28, the length of tip bent inwardly being selected such that the wires do not protrude substantially beyond the inner surface of the ferrule 20. The wires 21 are welded at their tips 30 to the ferrule 20 or can be retained in place by engagement with an external member, such as provided by the outer body 1. The wires 21 extend at an angle obliquely along the central portion 22 and are bent, where they project from the flanges 25 and 26, parallel to the axis of the ferrule and parallel to the surface of the end portions 23 and 24. The wires 21, therefore, are arranged in a hyperboloid configuration and the wall thickness of the central portion 22 is such that the wires midway along their length project inwardly beyond the inner surface of the ferrule into its bore. In this way, the diameter of the central passage between the wires 21 reduces to a minimum midway along the central portion 22, providing a contact region where a male pin contact 3 makes a wiping contact with the wires as it is inserted from the forward end of the socket 2.

Figure 3:
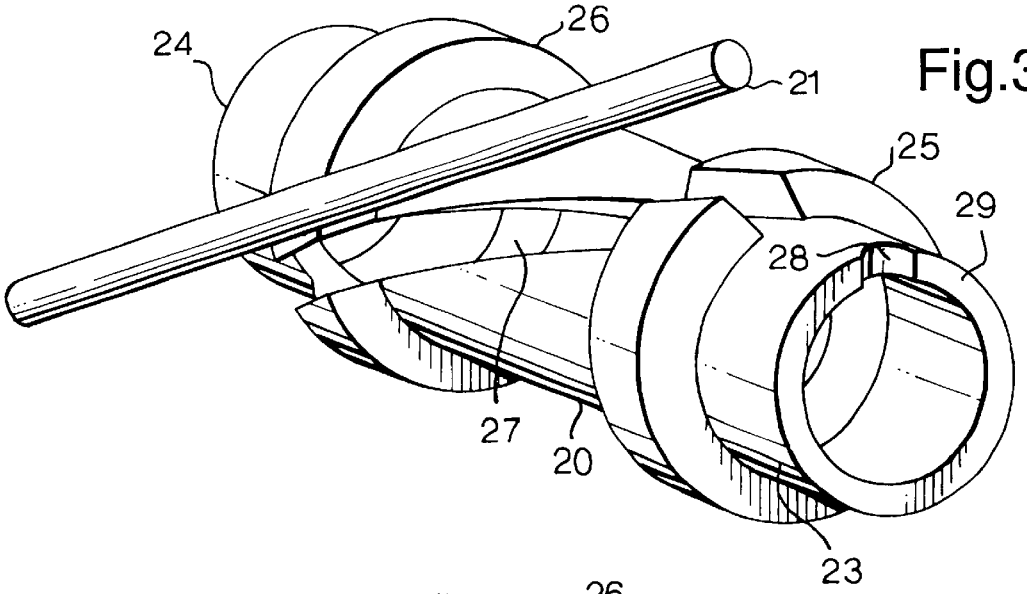
FIGS. 3 and 4 illustrate preliminary stages in manufacture of the assembly.
Figure 4:
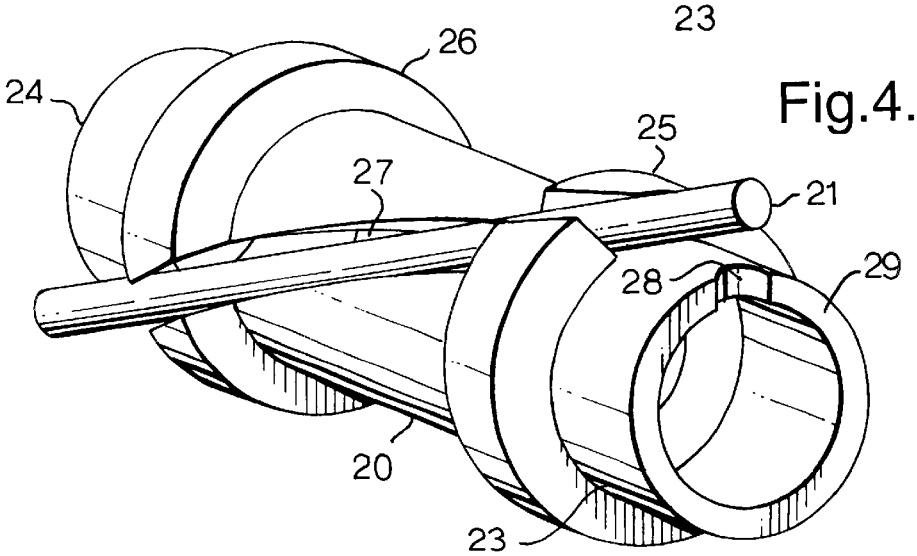

The socket 2 is made in the manner shown in FIGS. 3 to 4. The ferrule 20 is provided with the slots 27, such as by machining, and the wires 21, in a straight form, are laid from the outside of the ferrule along the slots 27 so that they extend between the flanges 25 and 26, as shown in FIGS. 3 and 4. The slot 27 through the flanges 25 and 26 serves to locate the wires 21 against lateral movement. In this preliminary stage, the ends of the wires 21 extend outwardly at an angle away from the ferrule 20 along the end regions 23 and 24. The next step is to bend the ends of the wires 21 inwardly, as shown in FIG. 2, so that they lie flat against the end regions 23 and 24, and so that the tips 30 locate in the notches 28. The wires 21 are then welded onto the end regions 23 and 24. After the wires 21 have been attached with the ferrule 20, the socket 2 is inserted into the body 1 to complete the assembly.

Figure 5:
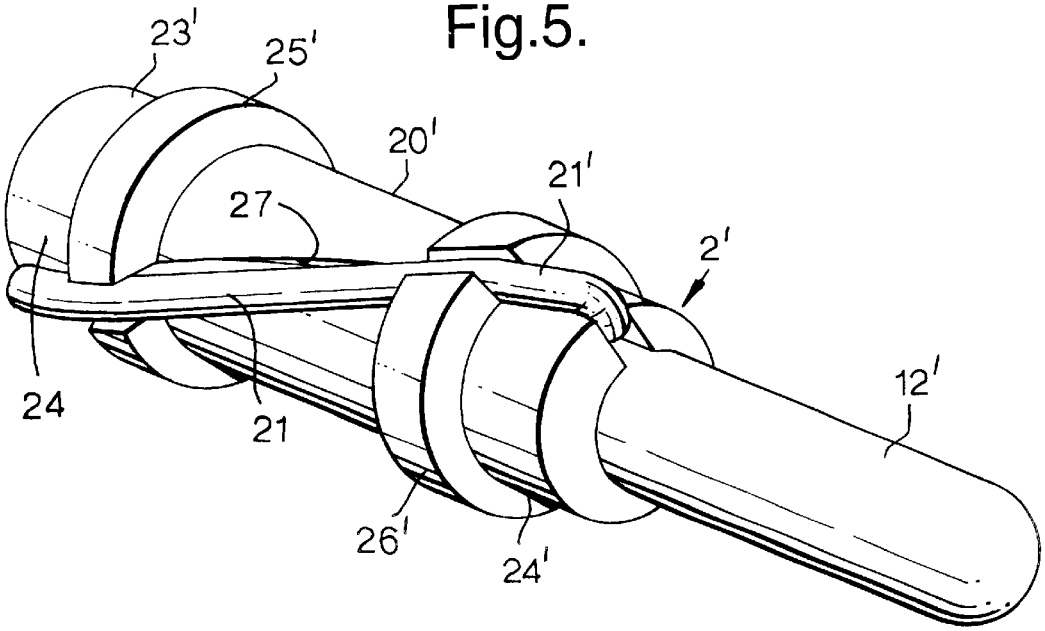
FIG. 5 is a perspective view of an alternative socket assembly from its rear end.

Instead of having the tail of the socket assembly provided by a separate body into which the socket is inserted, the tail 12' could be provided integral with the ferrule 20', as shown in FIG. 5, in which components equivalent to those in the socket 2 shown in FIGS. 1 and 2 are given the same reference numbers with the addition of a prime '. In this arrangement the tail 12' is machined from the same piece of metal as the ferrule 20' and the assembly is completed by inserting into a hole through an insulator body together with other socket assemblies.

Because the wires of the contact can be loaded externally and because the slots act to locate the wires in position, the present invention facilitates assembly and thereby enables a socket contact having hyperboloid wires to be provided at a reduced cost. The sockets can be made readily by automated machines with the consequent improved reliability and reduced cost. Cost is also reduced because the socket only requires a single component to locate both ends of the wires, whereas previous sockets have required two separate rings. In the present invention, the wires do not need to be wrapped around the both the outside and inside of a ring or the like. This enables the ferrule to be thinner and removes one thickness of wire, thereby enabling the external diameter of the contact to be reduced. The length of wire required is also reduced, with a consequent cost reduction. The forward end of the ferrule can easily be made to extend beyond the end of the wires so as to protect them. In such an arrangement, if the ferrule is of an electrically non-conductive material, the ferrule can help protect against inadvertent contact with a live socket.

What I claim is:

1. An electrical socket contact comprising: a tubular member, said tubular member having two opposite ends, an inner surface, an external surface, a plurality of locations at each said end, respective locations at opposite ends being spaced angularly from one another, and a plurality of slots extending between said respective locations obliquely of said tubular member; and a plurality of metal wires supported by said tubular member, said wires being attached at opposite ends at respective ones of said locations and extending externally of said tubular member towards their ends and extending along respective ones of said slots obliquely of said socket such that at a region between their ends said wires extend inwardly beyond said inner surface to provide a contact region of said contact.

2. A contact according to claim 1, wherein said tubular member has an external member towards each end spaced from said ends by respective end regions, and wherein each said wire is bent at said external member to extend along a surface of the respective end region at both ends.

3. A contact according to claim 1, wherein said tubular member has a locating notch at each end for each said wire.

4. A contact according to claim 1, wherein said tubular member is of a metal.

5. A contact according to claim 4, wherein said wires are welded at their ends to said tubular member.

6. A contact according to claim 1, wherein said wires are spring metal wires of circular section.

7. A contact according to claim 1 including an outer metal tubular body, wherein said tubular member is inserted within said outer body, and wherein said outer body includes a contact portion to which a wire can be attached.

8. A contact according to claim 1, wherein said tubular member is of metal and wherein said tubular member is formed at one end with a contact portion to which a wire can be attached.

9. A contact according to claim 1, wherein said wires extend on an inside of said tubular member only in a region of said tubular member towards its midpoint.

10. An electrical socket contact comprising: a tubular member, said tubular member having two opposite ends, an inner surface, an external surface, a flange towards each end spaced from said end by an end region, and a plurality of slots extending through said tubular member and both said flanges, said slots extending obliquely of said tubular member; and a plurality of metal wires supported by said tubular member, said wires extending along said slots obliquely of the contact to project inwardly of said tubular member midway along their length, said wires being bent where they extend through slots in said flanges to extend along said external surface of said end region, and said wires being attached with said tubular member at opposite ends at said end regions.

11. An electrical socket comprising: a tubular member, said tubular member having a plurality of oblique slots extending along a major part of the length of the tubular member; and a plurality of metal wires, one for each slot, extending from respective external locations at opposite ends of said tubular member along said slots to extend inwardly of said tubular member at a midpoint along its length and thereby provide a contact region for a member inserted within said socket.

12. An electrical socket contact comprising; a socket, said socket including two annular regions at opposite ends; and a plurality of metal wires extending along oblique slots, said slots extended along a major part of the length of said socket, wherein said wires extend in a hyperboloid arrangement and are exposed for contact with a male contact member inserted within said socket, and wherein opposite ends of said wires are attached to respective one of said annular regions and extend along an external surface of said annular region, without extending along its internal surface.

13. A method of making an electrical socket, comprising the steps of: providing a plurality of electrically-conductive spring wires; providing a tubular member, said tubular member having two annular regions at opposite ends and a plurality of slots extending obliquely of said tubular member between said annular regions; positioning said wires to extend along respective ones of said slots and along an external surface of respective ones of said annular regions at opposite ends; and securing said wires at opposite ends with said annular regions.

14. A method according to claim 13, wherein said wires are assembled on said tubular member from the exterior of said tubular member.

15. A method according to claim 13, wherein said wires are secured with said annular regions by welding.

* * * * *